US007366604B2

(12) United States Patent
Ishii et al.

(10) Patent No.: US 7,366,604 B2
(45) Date of Patent: Apr. 29, 2008

(54) FUEL VAPOR TREATMENT SYSTEM WITH LEAK DIAGNOSING

(75) Inventors: Hiroya Ishii, Yokohama (JP); Takeshi Tsuyuki, Yokohama (JP); Takane Hayashi, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 292 days.

(21) Appl. No.: 11/261,474

(22) Filed: Oct. 31, 2005

(65) Prior Publication Data

US 2006/0130568 A1 Jun. 22, 2006

(30) Foreign Application Priority Data

Dec. 21, 2004 (JP) ..... 2004-369185

(51) Int. Cl.
*F02M 33/02* (2006.01)
*F02N 25/08* (2006.01)

(52) U.S. Cl. ..... 701/103; 123/520; 73/118.1

(58) Field of Classification Search ..... 701/103, 701/114; 123/516–520, 198 D, 250; 73/119 R, 73/118.1

See application file for complete search history.

(56) References Cited

U.S. PATENT DOCUMENTS 6,276,343 B1 * 8/2001 Kawamura et al. ..... 123/520
6,367,458 B1 * 4/2002 Furusho et al. ..... 123/519
6,389,882 B1 * 5/2002 Ohkuma ..... 73/49.7
6,832,509 B2 12/2004 Morinaga et al.

FOREIGN PATENT DOCUMENTS

JP 2003-74421 A 3/2003

* cited by examiner

*Primary Examiner*—Willis R. Wolfe
*Assistant Examiner*—Johnny H. Hoang
(74) *Attorney, Agent, or Firm*—Global IP Counselors, LLP

(57) ABSTRACT

A fuel vapor purge system is configured to execute a highly accurate leak diagnosis with respect to a fuel vapor leak. After the engine is stopped, the temperature of the fuel vapor rises temporarily and then decreases until it reaches the outside ambient temperature. During this period, the purge line is closed off and a minimum value reached by the purge line pressure is detected. The difference between the minimum value of the purge line pressure and the atmospheric pressure is compared to a threshold value. The purge system is diagnosed as "normal" if the difference is equal to or larger than the threshold value and a "leaking" if the difference is less than the threshold value.

11 Claims, 8 Drawing Sheets

FUEL VAPOR TREATMENT SYSTEM WITH LEAK DIAGNOSING

CROSS-REFERENCE TO RELATED APPLICATIONS

This application claims priority under 35 U.S.C. § 119 to Japanese Patent Application No. 2004-369185. The entire disclosure of Japanese Patent Application No. 2004-369185 is hereby incorporated herein by reference.

BACKGROUND OF THE INVENTION

1. Field of the Invention

The present invention relates generally to a fuel vapor treatment system configured to be used with an internal combustion engine for an automobile. More specifically, the present invention relates a fuel vapor treatment system equipped with a leak diagnosing system.

2. Background Information

A conventional fuel vapor treatment system for an internal combustion engine is configured to direct fuel vapor produced in a fuel tank into a canister so as to allow the fuel vapor to be temporarily adsorbed. The fuel vapor adsorbed in the canister is then sent to an air intake system of the internal combustion engine by introducing fresh air into the canister through a fresh air introducing port and allowing the fresh air and fuel vapor to be drawn into the air intake system through a purge control valve. In this way, fuel vapors are prevented from being released to the outside air.

However, if a crack develops in the piping of the purge line running from the fuel tank to the canister and from the canister to the purge control valve, or if a poor seal occurs at a joint portion of the piping, then fuel vapor will leak out and the fuel vapor treatment system will not be able to sufficiently prevent the release of fuel vapor to the outside air.

In response to the possibility of such a leak, leak diagnosing systems have been contrived that are configured to determine if fuel vapor is leaking from the purge line. One such system is disclosed in Japanese Laid-Open Patent Publication No. 2003-74421. In the system disclosed this publication, the purge line is closed off after the engine is stopped by closing the purge control valve and closing a fresh air introducing port on/off valve that is arranged and configured to open and close the fresh air introducing port (which is open to the atmosphere). After the purge line is closed off, the leak diagnosing system calculates the difference between the maximum value and the minimum value of the purge line pressure during a leak diagnosis period and determines if a leak exists based on the difference.

In view of the above, it will be apparent to those skilled in the art from this disclosure that there exists a need for an improved leak diagnosing system. This invention addresses this need in the art as well as other needs, which will become apparent to those skilled in the art from this disclosure.

SUMMARY OF THE INVENTION

It has been discovered that when a leakage determination is based on the difference between a maximum value and a minimum value of the purge line pressure as in the above mentioned publication, the maximum value of the purge line pressure is very easily affected by the amount of evaporated fuel, which depends on the fuel (gasoline) properties. Consequently, the diagnosis must be executed while accepting the fact that the chances of an incorrect determination are high or it is necessary establish more stringent conditions under which the diagnosis is allowed.

The present invention was conceived in view of this unresolved issue. One object of the present invention is to provide a leak diagnosing system for a fuel vapor treatment system that can perform a highly precise leak diagnosis when the engine operation is stopped (i.e., when the engine is not running).

The present invention is configured to close off the purge line after engine operation is stopped and determine the leakage state of the purge line based on the amount by which the purge line pressure decreases due to a temperature decrease occurring within a temperature region lower than the temperature that existed immediately after the engine operation was stopped. When the purge line is closed off immediately after the engine operation is stopped, the pressure decreases because the temperature decreases. If the fuel vapor purge system (purge line) is normal, the purge line pressure will fall far below atmospheric pressure. Conversely, if a leak exists, the purge line pressure will converge toward the atmospheric pressure and the pressure decrease will be small. Therefore, the leakage state can be determined based on the amount by which the pressure decreases.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
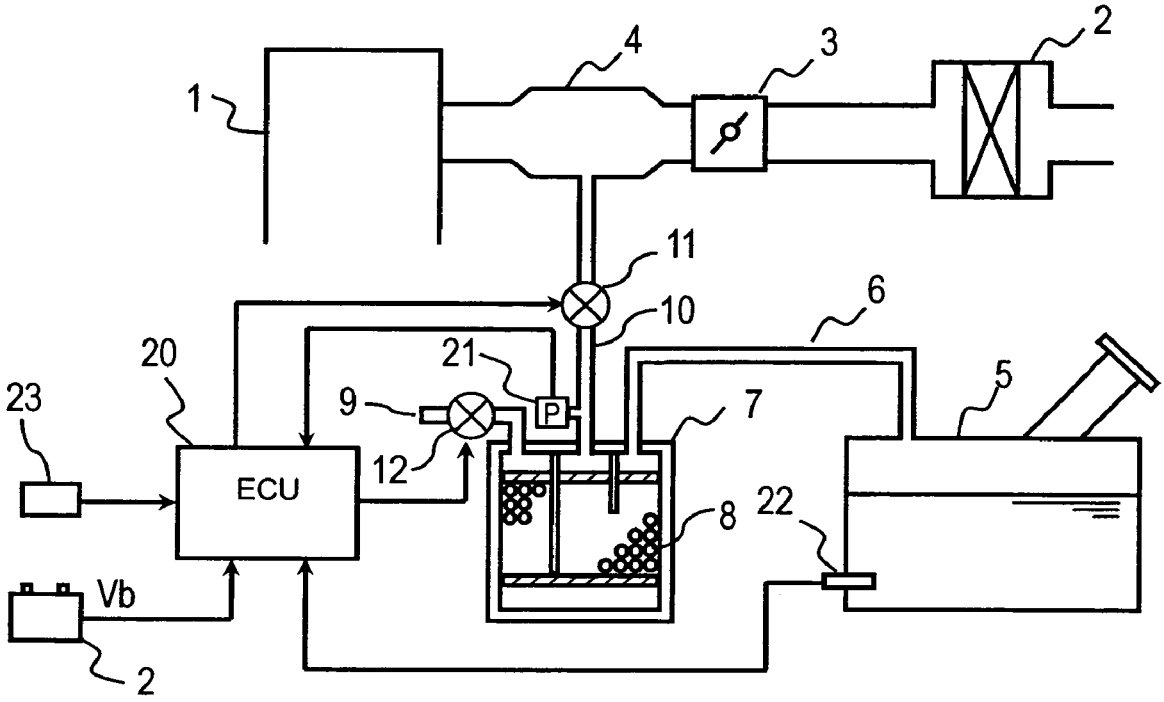
FIG. 1 is a schematic view of a portion of an engine utilizing a fuel vapor treatment system in accordance with a first embodiment of the present invention.

Referring initially to FIG. 1, a portion of an internal combustion engine 1 is illustrated that utilizes a fuel vapor treatment system in accordance with a first embodiment of the present invention. The internal combustion engine 1 has an air intake system that includes an air cleaner 2, a throttle valve 3, and an intake air manifold 4 in that order from an upstream end to a downstream end. A fuel injection valve or injector (not shown) is provided in each of the cylinders to supply fuel to the cylinders from the fuel tank 5 in a conventional manner.

The fuel vapor treatment system is fluidly connected between the intake air manifold 4 of the engine 1 and the fuel tank 5. The fuel vapor treatment system basically includes a fuel vapor guide passage 6 that is arranged to guide fuel vapor produced in the fuel tank 5 to a canister 7. The canister 7 is configured to temporarily adsorb the fuel vapor produced in the fuel tank 5. For example, the canister 7 contains a fuel adsorbing material (e.g., activated carbon or other adsorbing material) that temporarily adsorb the fuel vapor. The canister 7 is provided with a fresh air introducing port 9 that opens to the atmosphere and a purge passage 10 that leads out of the canister 7. The purge passage 10 connects to the air intake manifold 4 at a position downstream of the throttle valve 3. A purge control valve 11 is provided at an intermediate position along the purge passage 10. The purge control valve 11 is configured to open in response to a signal sent from an engine control unit or "ECU" 20. The passages 6 and 10 together with the connecting portion of the canister 7 effectively form a purge line from the fuel tank 5 to the air intake manifold 4.

When the engine 1 is stopped (not running), fuel vapor generated inside the fuel tank 5 is guided by the fuel vapor guide passage 6 to the canister 7 and adsorbed. When the engine 1 is started and a prescribed purge allowance condition is satisfied, the purge control valve 11 is opened and the intake vacuum of the engine 1 acts on the canister 7, causing fresh air to be drawn into the canister 7 through the fresh air introducing port 9. The fresh air causes the adsorbed fuel vapor to be released and flow into the purge passage along with the fresh air, the fresh air and fuel vapor forming a purge gas. The purge gas is drawn into the air intake manifold 4 and then combusted inside the combustion chambers of the engine 1.

A component element of the leak diagnosing system of the fuel vapor treatment system is a fresh air introducing port on/off valve 12 provided in the fresh air introducing port 9 of the canister 7 and configured to open and close the fresh air introducing port 9. The fresh air introducing port on/off valve 12 is a non-throttling valve that either opens or closes the fresh air introducing port 9 of the canister 7.

When a prescribed leak diagnosis condition is satisfied, the engine control unit 20 controls the purge control valve 11 and the fresh air introducing port on/off valve 12, and then conducts the leak diagnosis. In order to conduct the leak diagnosis, the engine control unit 20 receives signals from a pressure sensor 21 and a fuel temperature sensor 22. The engine control unit 20 also receives an ON/OFF signal from an engine key switch 23 and a signal indicating a power supply voltage or battery voltage Vb from a battery 24 and uses these signals to determine if the lead diagnosis condition is satisfied.

The pressure sensor 21 is arranged to face into the purge passage 10 so that it can detect a pressure P (absolute pressure) in the purge line that funs from the fuel tank 5 to the purge control valve 11 via the canister 7.

The fuel temperature sensor 22 is arranged to face into the fuel tank 5 so that it can detect the fuel temperature Tf.

Figure 2:
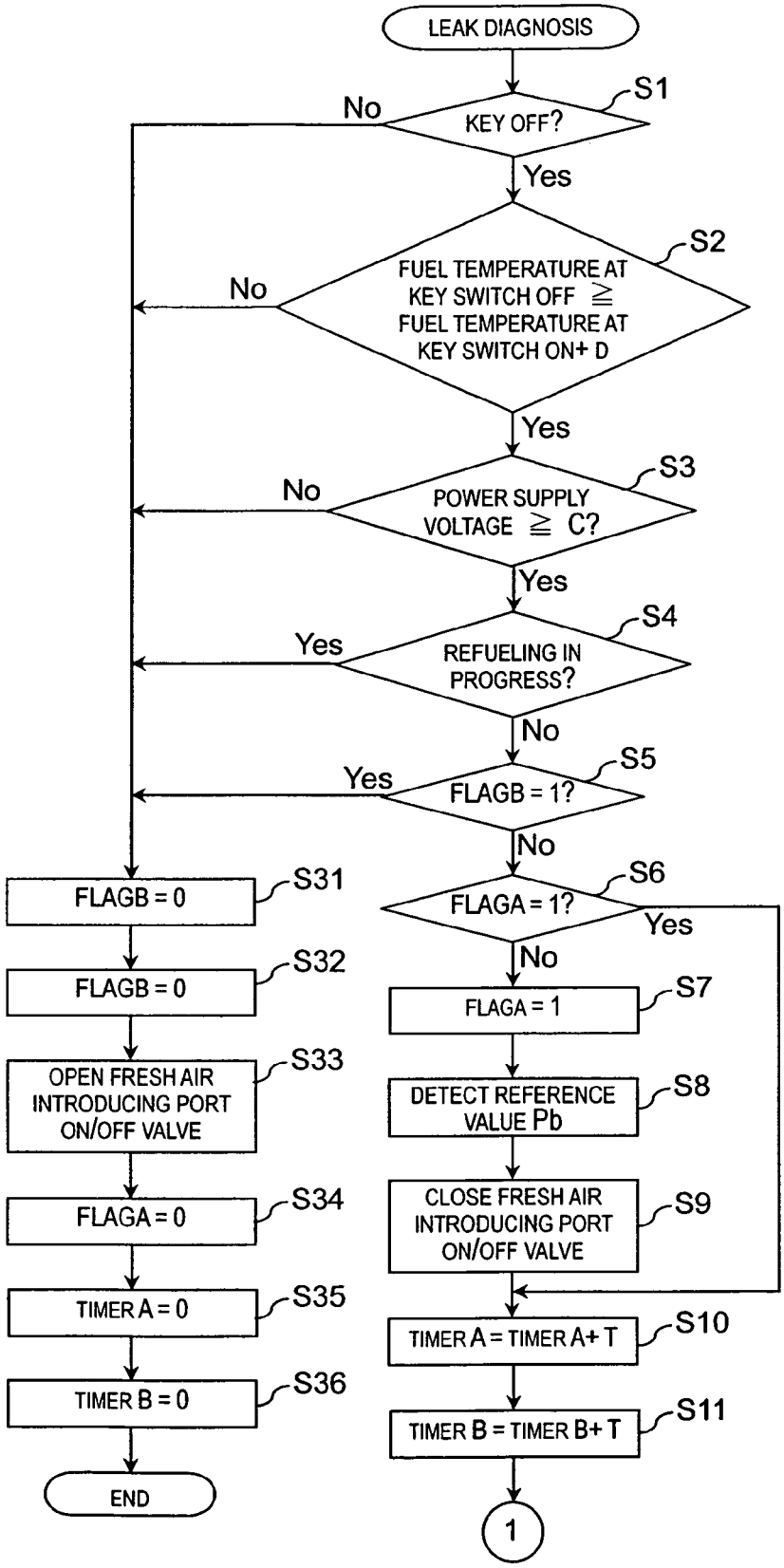
FIG. 2 is a control flowchart showing a first half of a control routine that is executed for performing a leak diagnosis in accordance with the first embodiment of the present invention.
Figure 3:
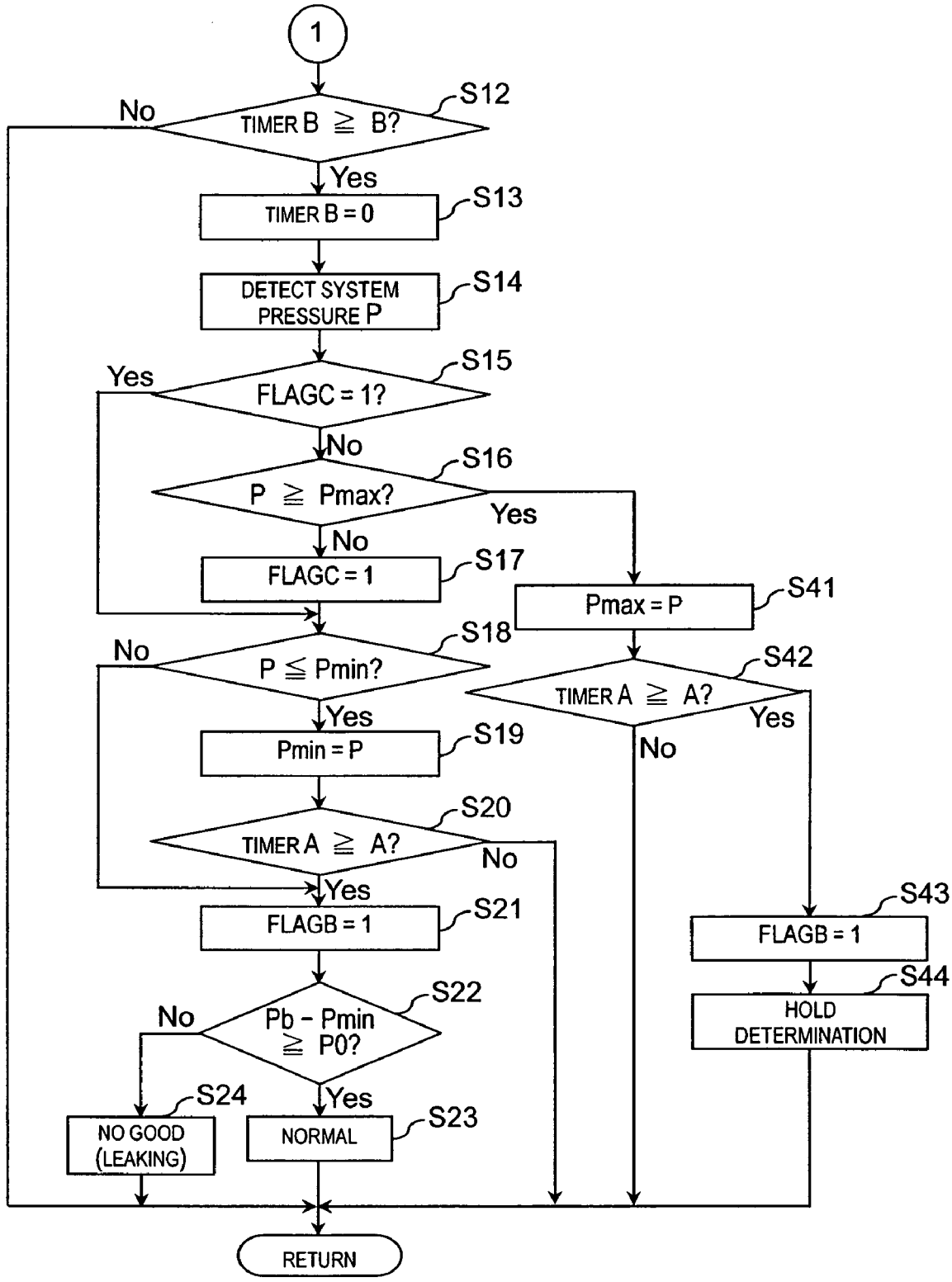
FIG. 3 is a control flowchart showing a latter or second half of a control routine that is executed for performing a leak diagnosis in accordance with the first embodiment of the present invention.

The control routine executed by the engine control unit 20 in order to diagnose the leakage state of the fuel vapor treatment system will now be described with reference to the flowcharts shown in FIGS. 2 and 3. Since the leakage determination in this control routine is executed while the vehicle is stopped, the accuracy of the diagnosis is not easily degraded by the operating conditions and, thus, the accuracy of the diagnosis can be ensured. Also, since the leak diagnosis is conducted while the temperature is falling within a temperature region that is below the temperature that exists immediately after the engine operation stops, much of the fuel that evaporated due to the increased temperature of the engine room while the engine was running has already condensed by the time the diagnosis is conducted. Thus, the effect of such evaporated fuel on the amount of fuel vapor involved in the diagnosis is reduced. Therefore, a highly accurate leak diagnosis can be conducted based on the pressure decrease resulting from the temperature decrease in the region.

In step S1, the engine control unit 20 is configured to determine if the engine key switch 23 has been turned OFF. If the engine is running and the engine key switch 23 is ON, the engine control unit 20 proceeds to step S31 and subsequent steps where it initializes flags and other values.

In step S31, the engine control unit 20 is configured to reset the leak diagnosis complete flag FLAGB to 0.

In step S32, the engine control unit 20 is configured to open the fresh air introducing port on/off valve 12.

In step S33, the engine control unit 20 is configured to reset the diagnosis condition satisfied flag FLAGA to 0.

In step S34, the engine control unit 20 is configured to clear a timer A for measuring the time elapsed since the diagnosis condition was satisfied.

In step S35, the engine control unit 20 is configured to clear a timer B for measuring the time period B during which the pressure change rate is calculated.

If the engine key switch 23 is found to be OFF in step S1, the engine control unit 20 proceeds to step S2.

In step S2, the engine control unit 20 is configured to determine if the fuel temperature Tfs at the time when the engine key switch 23 was turned off is higher than the fuel temperature at the time when the engine key switch was turned ON to start the engine 1 by a prescribed temperature D or more. If the fuel temperature Tfs is found to be higher by the prescribed temperature D or more, then the engine control unit 20 proceeds to step S3 because it can be assumed that when the purge line is closed off, the gas inside the purge line will have a sufficient quantity of heat to ensure a large enough temperature decrease to achieve a highly accurate leak diagnosis.

In step S3, the engine control unit 20 is configured to determine if the power supply voltage or battery voltage Vb is equal to or above a prescribed value C. If so, the engine control unit 20 determines that there is sufficient electric power available to start the engine again and proceeds to step S4. If the power supply voltage Vb is below the prescribed value C, the engine control unit 20 proceeds to steps S31 to S36 and ends the control routine.

In step S4, the engine control unit 20 is configured to determine if the vehicle is being refueled by, for example, determining if the rate at which the pressure in the purge line is increasing is equal to or larger than a prescribed value. If the vehicle is not being refueled, the engine control unit 20 proceeds to step S5. If the vehicle is being refueled, the engine control unit 20 proceeds to steps S31 to S36 and ends the control routine.

In step S5, the engine control unit 20 determines if the leak diagnosis has been completed or not by determining if the value of the flag FLAGB is 0 or 1. If the value is 1, then the leak diagnosis is incomplete and the engine control unit 20 proceeds to step S6. If the value is 0, then the leak diagnosis is complete and the engine control unit 20 proceeds to steps S31 to S36, ending the control routine.

In step S6, the engine control unit 20 is configured to determine whether or not it is the first time the control routine has been executed since the diagnosis condition was satisfied by determining if the value of the flag FLAGA is 0 or 1. If the value is 0, then the engine control unit 20 determines that it is the first time and proceeds to step S7.

In step S7, the engine control unit 20 sets the flag FLAGA to 1.

In step S8, the engine control unit 20 is configured to detect an atmospheric pressure Pb to be used as a reference pressure value with respect to the pressure inside the purge line during the leak diagnosis. More specifically, the atmospheric pressure Pb is the pressure currently detected by the pressure sensor 21 while the fresh air introducing port on/off valve 12 is open. When the fresh air introducing port on/off valve 12 is open, the pressure inside the purge line is approximately equal to the atmospheric pressure due to the ability of air to move from the outside to the purge line through the canister 7.

In step S9, the engine control unit 20 is configured to close both the purge control valve 11 and the fresh air introducing port on/off valve 12 and proceeds to step S10. As a result, the purge line running from the fuel tank 5 to the purge control valve 11 through the canister 7 is closed off.

Starting from the second time the control routine is executed after the diagnostic conditions are satisfied, the engine control unit 20 will skip from step S6 to step S10 because the value of the flag FLAGA is 1.

In step S10, the engine control unit 20 is configured to increment the value of the timer A (which serves to measure the time elapsed since the diagnosis condition was satisfied) by the cycle period T, i.e., by the time required to execute the control routine once.

In step S11, the engine control unit 20 is configured to increment the timer B (which serves to measure the time period B during which the pressure change rate is calculated) by the cycle period T.

In step S12, the engine control unit 20 is configured to determine if the value of the timer B has reached the time period B. If not yet, engine control unit 20 ends the current cycle of the control routine (i.e., returns to step S1). If so, the engine control unit 20 proceeds to step S13 and resets the value of the timer B to 0.

In step S14, the engine control unit 20 is configured to read in the purge line pressure (system pressure) P detected by the pressure sensor 21.

In step S15, the engine control unit 20 is configured to determine if the flag FLAGC has a value of 1. The flag FLAGC is set to 1 when the maximum pressure is detected. Initially (in the first cycle), the engine control unit 20 proceeds to step S16 because the flag FLAGC has been reset to 0.

In step S16, the engine control unit 20 is configured to determine if the purge line pressure P is equal to or larger than Pmax. If so, the engine control unit 20 proceeds to step S41 and updates the value of Pmax to the value of the current purge line pressure. The engine control unit 20 then proceeds to step S42.

In step S42, the engine control unit 20 is configured to determine if the amount of time elapsed since the diagnosis condition was satisfied, i.e., the value of the timer A, has reached a prescribed value A at which the diagnosis is to be ended.

If the prescribed value A has not yet been reached, the engine control unit 20 returns to step S1. If the prescribed value A has been reached, the engine control unit 20 proceeds to step S43 where it sets the value of the flag FLAGB to 1, and then to step S44 where it refrains from making a determination (does not commit to a particular diagnosis). After returning to step S1, the engine control unit 20 proceeds from step S5 to steps S31 to S36 and ends the routine.

If the purge line pressure P is found to be less than Pmax in step S16, the engine control unit 20 proceeds to step S17 and sets the flag FLAGC to 1.

Thus, so long as the purge line pressure P continues to rise, the latest purge line pressure P is set as the value of Pmax. When the purge line pressure P reaches its actual maximum value where it stops rising and starts falling, the system sets that maximum value as Pmax.

If the set time A elapses before the maximum value is detected, i.e., while the purge line pressure P is still rising, the diagnosis cannot be conducted and the system refrains from making a determination in order to reduce the electric power consumption.

When the maximum value Pmax has been calculated as just described, the engine control unit 20 proceeds to step S18 and subsequent steps and calculates a minimum value of the purge line pressure P.

In step S18 the engine control unit 20 is configured to determine if the purge line pressure P is equal to or below a value Pmin. If so, the engine control unit 20 proceeds to step S19 and updates the value of Pmin to the current purge line pressure P. The engine control unit 20 then proceeds to step S20.

In step S20, the engine control unit 20 is configured to determine if the amount of time elapsed since the diagnosis condition was satisfied, i.e., the value of the timer A, has reached a prescribed value A at which the diagnosis is to be ended.

If the prescribed value A has not yet been reached, the engine control unit 20 returns to step S1. If the prescribed value A has been reached, the engine control unit 20 proceeds to step S21 where it sets the value of the flag FLAGB to 1 and then proceeds to step S22. If it is found that the purge line pressure P exceeds the value of Pmin in step S18, the engine control unit 20 jumps to step S21.

Thus, so long as the purge line pressure P continues to fall, the latest purge line pressure P is set as the value of Pmin. When the purge line pressure P reaches its actual minimum value where it stops falling and starts rising, the system sets that minimum value as Pmin. Or, if the amount of time elapsed since the diagnosis condition was satisfied reaches the prescribed value A while the purge line pressure P is still continuing to fall, the purge line pressure P at that point in time is set as the minimum value Pmin.

In step S22, the engine control unit 20 is configured to determine if the value obtained by subtracting the minimum value Pmin from the reference atmospheric pressure Pb detected in step S8 is equal to or larger than a diagnostic threshold value P0. The threshold value P0 is set in a variable manner such that the larger the volume of the empty space inside the fuel tank 5 (i.e., the volume obtained by subtracting the volume of the remaining fuel measured with a fuel level gauge from the total volume of the tank), the smaller the value of the threshold value P0.

If the difference Pb−Pmin is equal to or larger than the threshold value P0, the engine control unit 20 proceeds to step S23 where it determines that the purge line (fuel vapor treatment system) is normal. Meanwhile, if the difference Pb−Pmin is smaller than the threshold value P0, the engine control unit 20 proceeds to step S24 where it determines that a leak exists in the purge line. The engine control unit 20 then returns to step S1 and then proceeds to step S31 from step S5.

Figure 4:
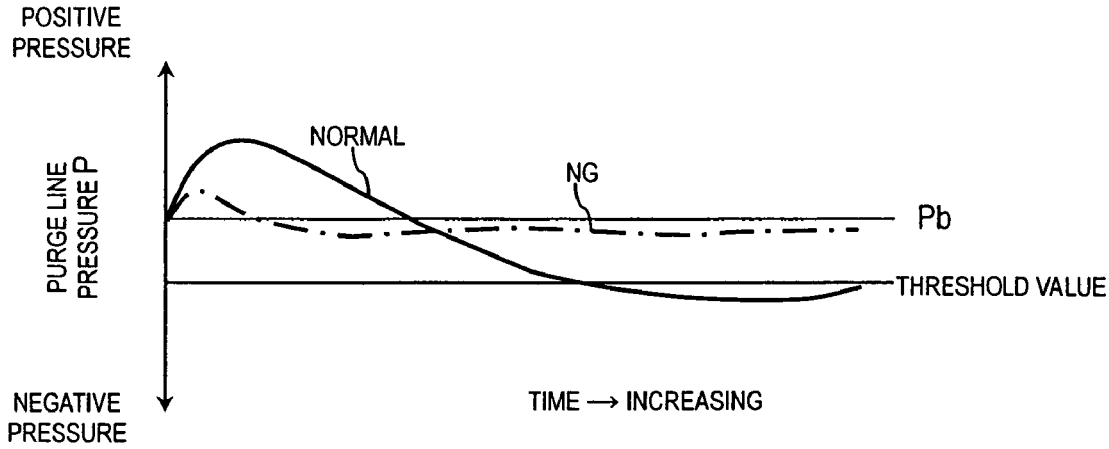
FIG. 4 is a control timing chart showing a pressure behavior that occurs during a leak diagnosis in accordance with the first embodiment of the present invention.

FIG. 4 shows how the purge line pressure P varies over time during the diagnosis described above.

After the engine is stopped, the temperature inside the engine room rises because the cooling fan stops and this temperature rise causes the purge line pressure P to rise temporarily because the air pressure and fuel vapor pressure inside the fuel tank increases. Afterwards, the fuel tank temperature decreases to the outside ambient temperature due to natural cooling and, accordingly, the purge line pressure P decreases.

When the purge line is normal, the pressure rise is large and purge line pressure P falls below atmospheric pressure when the temperature decreases to the outside ambient temperature, which is lower than the temperature that exists immediately after the engine is stopped.

Meanwhile, if the purge line is no good (i.e., leaking), the amount by which the purge line pressure P rises is small and the purge line pressure P converges toward atmospheric pressure because the purge line is open to the atmosphere (ambient air).

Therefore, the purge line can be diagnosed as normal when the purge line pressure P falls below the atmospheric pressure by a prescribed threshold value or more and the purge line can be diagnosed as leaking (no good) when the purge line pressure P falls below the atmospheric pressure by an amount smaller than a prescribed threshold value (or does not fall below atmospheric pressure.

In conventional systems configured such that the leakage determination is based on the difference between a maximum value and a minimum value of the purge line pressure, the pressure rise that occurs immediately after the engine is stopped will be large in cases where the amount of evaporated fuel is large—even if a leak exists. In such cases, the pressure difference is large and the changes of making an incorrect diagnosis are increase. Conversely, in a system in accordance with the present invention, the diagnosis is based on a pressure decrease amount that occurs in a temperature region that is lower than the temperature state that exists when the engine is stopped and, preferably, the diagnosis is based on the amount by which the pressure falls below atmospheric pressure, as is done in this embodiment. As a result, with the present invention, a highly accurate diagnosis can be accomplished without being affected by the amount of evaporated fuel.

Since the diagnosis time is not allowed to exceed an upper limit time A, the electric power consumption can be prevented from exceeding a prescribed value.

Although the amount by which the pressure decreases with respect to a given decrease in temperature becomes smaller as the volume of empty space inside the fuel tank 5 increases, the effect of the fuel level (amount of remaining fuel) on the diagnosis is eliminated by setting the threshold value P0 in a variable manner in accordance with the volume of empty space. As a result, a highly accurate diagnosis can be accomplished.

Since the diagnosis is executed when the engine is stopped, an accurate diagnosis that is not affected by sloshing can be accomplished and a chance to purge fuel vapor while the engine is running is not lost due to the diagnosis.

Figure 5:
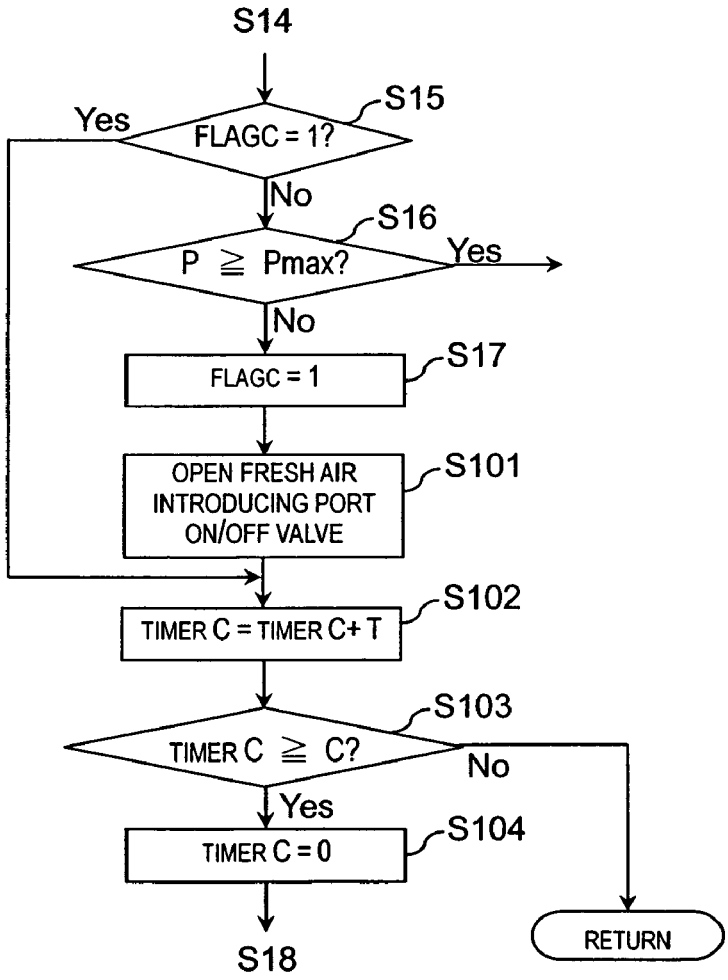
FIG. 5 is a flowchart showing key elements of a control routine that is executed for performing a leak diagnosis in accordance with a second embodiment of the present invention.

A second embodiment of a leak diagnosis will now be explained with reference to the flowchart of FIG. 5 (only the portions different from the first embodiment are shown).

In the second embodiment, the flow of steps is the same as the first embodiment up to step S17, where the maximum value Pmax of the purge line pressure P is detected. Then, in step S101, the engine control unit 20 is configured to open the fresh air introducing port on/off valve 12 temporarily such that the purge line is opened (released) to the outside. In step S102, the engine control unit 20 is configured to increment a timer C for measuring the amount of time elapsed since the purge line was opened by the cycle period T. In step S103, the engine control unit 20 is configured to determine if the value of the timer C has reached a set value C. If not, the engine control unit 20 returns to step S1. If so, the engine control unit 20 proceeds to step S104 and resets the value of the timer C to 0 before proceeding to step S18. Then, in the same manner as the first embodiment, the engine control unit 20 calculates the minimum value Pmin and diagnoses the purge system as normal if the difference between the atmospheric pressure Pb and the minimum value Pmin is equal to or larger than a threshold value P0 and as leaking if the difference is smaller than the threshold value P0.

Figure 6:
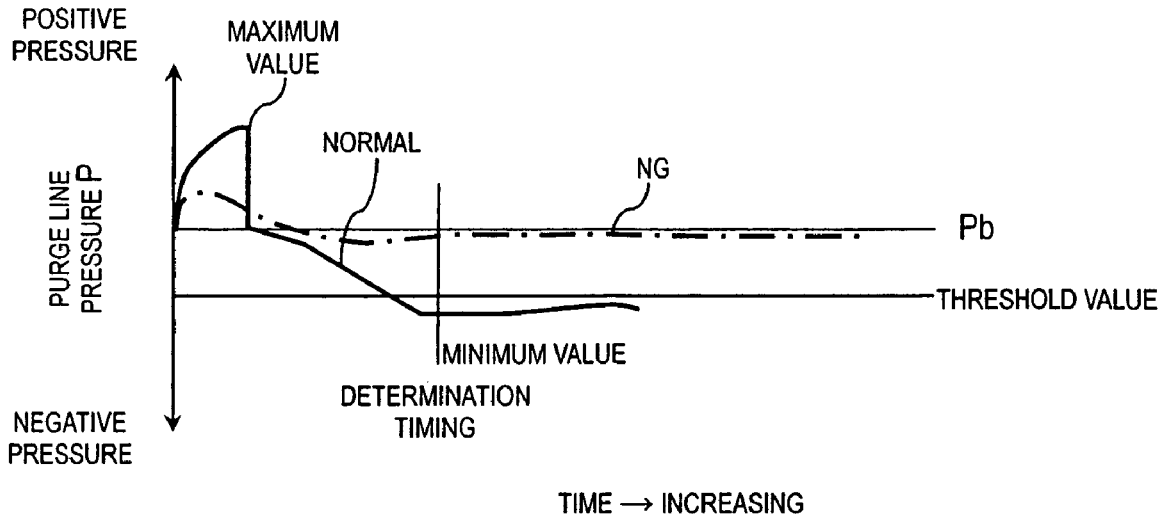
FIG. 6 is a timing chart showing a pressure behavior that occurs during a leak diagnosis in accordance with the second embodiment of the present invention.

Thus, as shown in FIG. 6, the second embodiment drops the purge line pressure to atmospheric pressure in a rapid fashion at the point in time when the maximum value of the purge line pressure P is detected and allows the pressure decrease caused by the falling of the temperature to occur from atmospheric pressure. As a result, the time required for the pressure to reach its minimum value can be shortened and the electric power consumption can be reduced.

Figure 7:
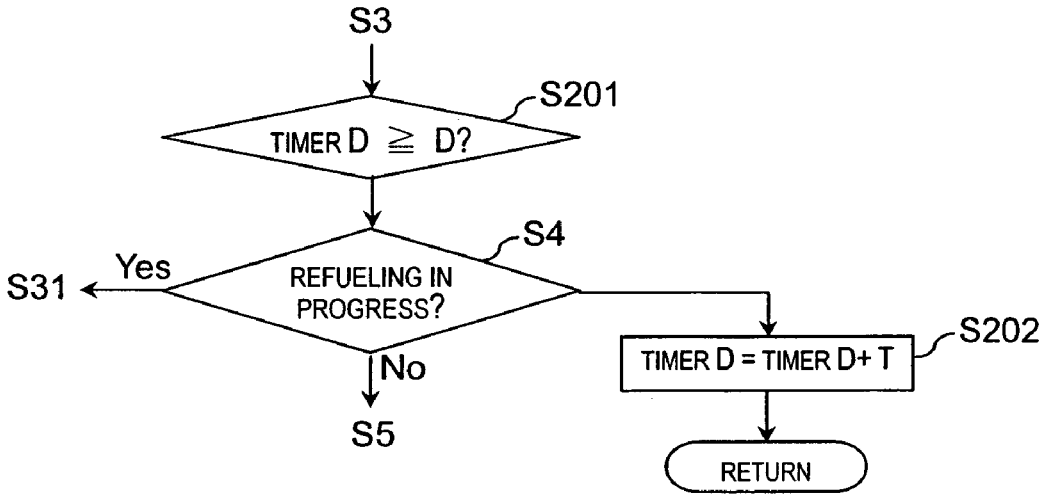
FIG. 7 is a flowchart showing key elements of a control routine that is executed for performing a leak diagnosis in accordance with a third embodiment of the present invention.

A third embodiment of a leak diagnosis will now be explained with reference to the flowchart of FIG. 7 (only the portions different from the first embodiment are shown).

In the third embodiment, immediately after the engine is stopped, in step S201 the engine control unit 20 checks the value of a timer D for measuring the elapsed time. In step S202, the engine control unit 20 is configured to increment the timer D by the cycle period T and returns. The engine control unit 20 does not proceed to step S4 until it finds that the timer D has reached a set value D in step S201.

Thus, after the engine is stopped, the fresh air introducing port on/off valve 12 is held open such that the purge line is released to the outside atmosphere for a prescribed amount of time. As a result, similarly to the second embodiment, the time required for the purge line pressure P to reach its minimum value after the purge line is closed off is shortened and the electric power consumption can be reduced. Furthermore, if the vehicle is refueled during the period when the purge line is released to the atmosphere after the engine is stopped, the leak diagnosis can be continued after the refueling is finished.

Figure 8:
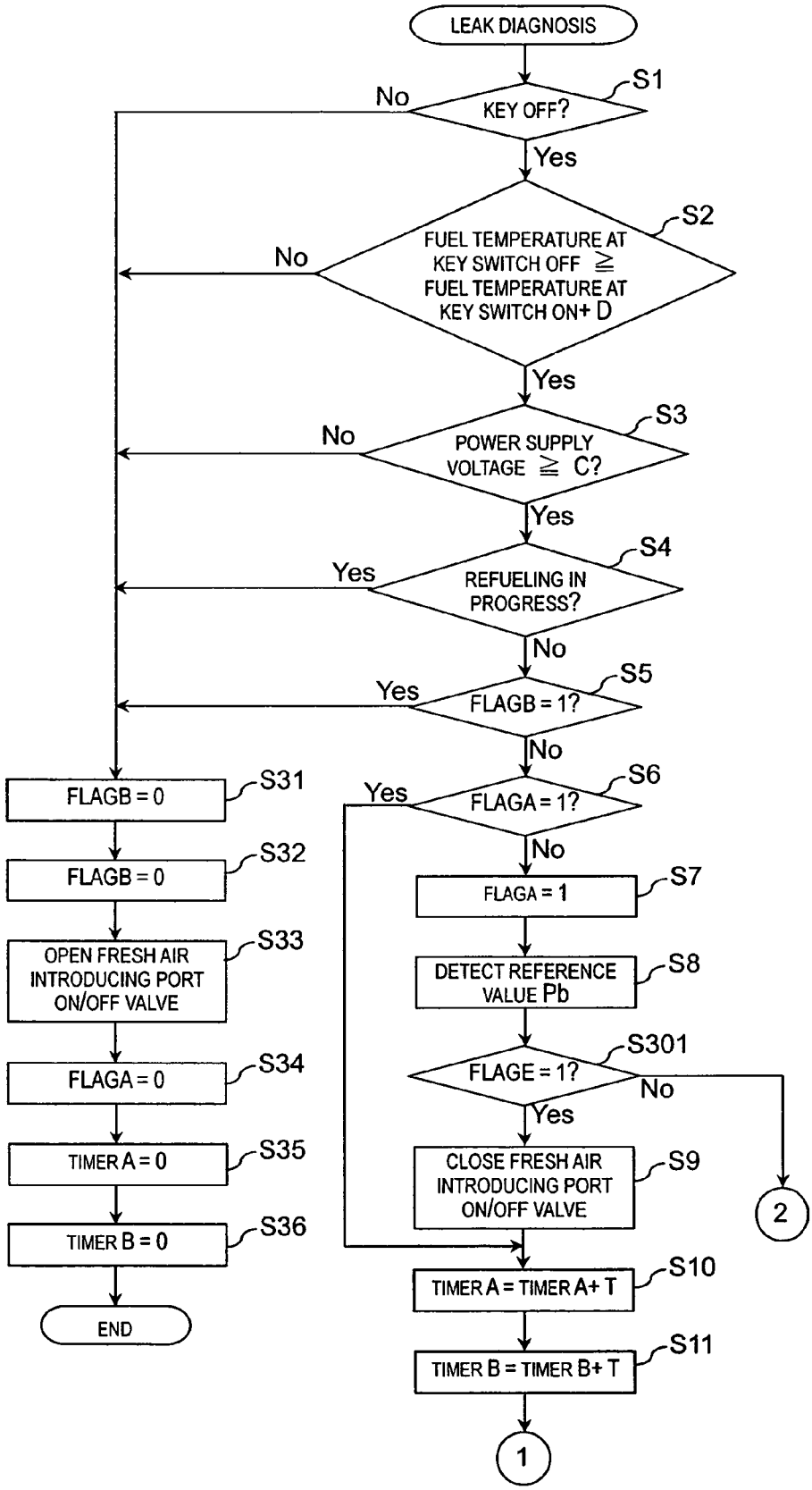
FIG. 8 is a flowchart showing a first half of a control routine that is executed for performing a leak diagnosis in accordance with a fourth embodiment of the present invention.
Figure 9:
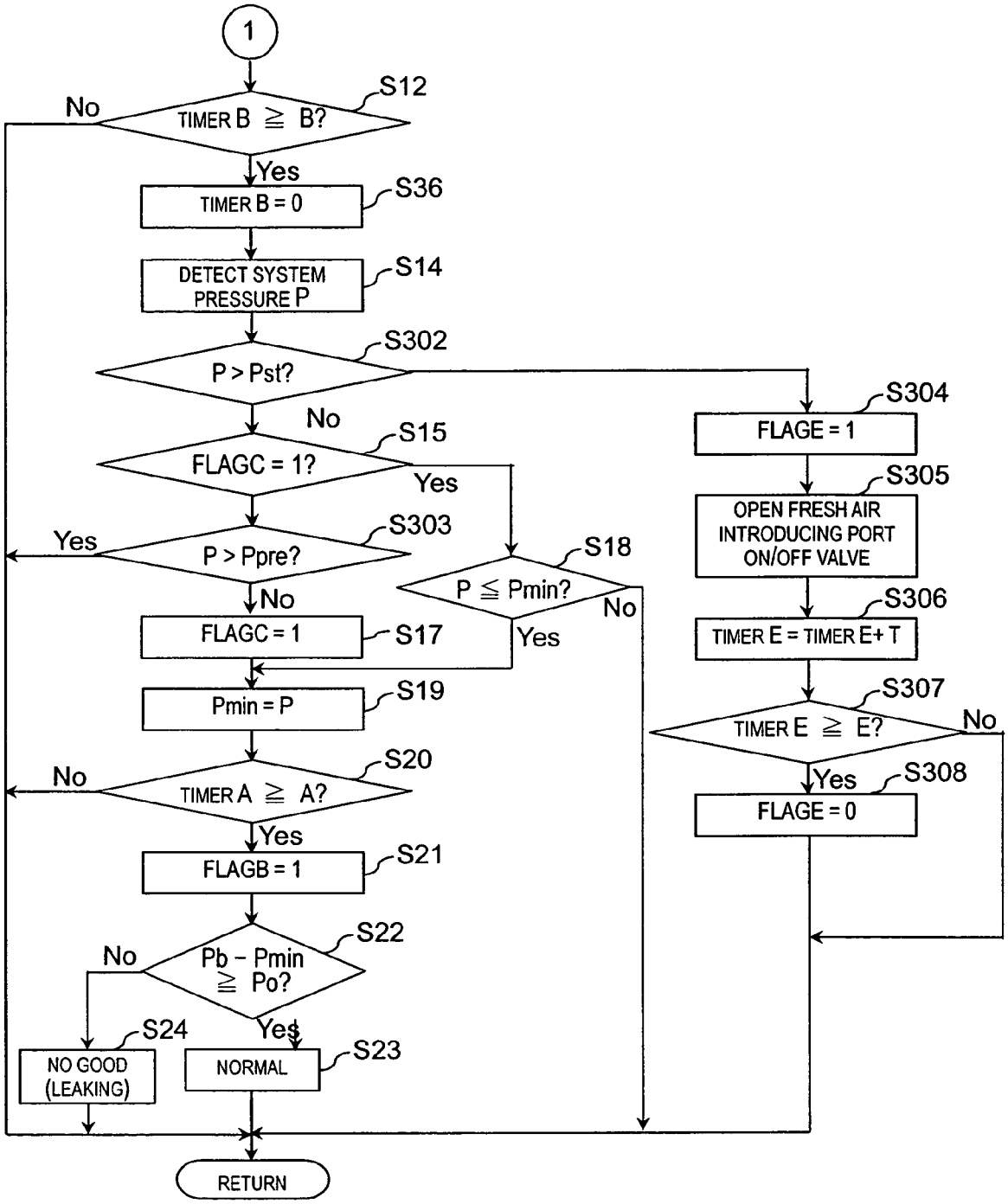
FIG. 9 a flowchart showing a latter or second of a control routine that is executed for performing a leak diagnosis in accordance with the fourth embodiment of the present invention.

A fourth embodiment of a leak diagnosis will now be explained with reference to the flowcharts of FIGS. 8 and 9.

In this embodiment, the flow of steps is the same as the first embodiment up to when the atmospheric pressure Pb is detected. Then, in step S301, the engine control unit 20 checks the value of a flag FLAGE.

The default value (reset value) of the flag FLAGE is 0. If the value of the flag FLAGE is 1, the engine control unit 20 proceeds to step 9 and subsequent steps. After the purge line has been closed off and the pressure detection period B has elapsed, the engine control unit 20 proceeds to step S302 and compares the purge line pressure P to a set pressure Pst.

If the engine control unit 20 determines in step S302 that the purge line pressure P is equal to or lower than the set pressure Pst, it proceeds to step S115 and determines if the maximum pressure calculation complete flag FLAGC is set to 1.

If the value of the flag FLAGC is 0 because the maximum pressure calculation has not yet been calculated, the engine control unit 20 proceeds to step S303 where it determines if the purge line pressure P is above the previous value Ppre (i.e., the purge line pressure P detected in the previous cycle). If so, the engine control unit 20 returns to step S1. If not, i.e., if the purge line pressure P is equal to or less than the previous value Ppre, the engine control unit 20 determines that the maximum value of the purge line pressure P has been detected because the pressure has stopped rising and started falling and the engine control unit 20 proceeds to step S17. In step S17, the engine control unit 20 sets the value of the flag FLAGC to 1.

Thereafter, the engine control unit 20 proceeds from step S15 to S18. Then, in steps S19 to S24, the engine control unit 20 is configured to calculate the minimum pressure value Pmin in the same manner as the previous embodiments and configured to determine if a leak exists by comparing the difference Pb−Pmin with the threshold value P0.

Meanwhile, if it determines in step S302 that the rising purge line pressure P has exceeded the set pressure Pst, the engine control unit 20 proceeds to step S304 and sets the flag FLAGE to 1. Then, in step S305 the engine control unit 20 is configured to open the fresh air introducing port on/off valve 12. As a result, the purge line is opened to the atmosphere and the pressure falls.

In step S306, the engine control unit 20 increments a timer TE for measuring the time elapsed since the fresh air introducing port on/off valve 12 was opened by the cycle period T. In step S307, the engine control unit 20 compares the value of the timer TE to a prescribed time E. Until the value of the timer TE reaches the prescribed time E, the engine control unit 20 returns to S1 from step S307 and to step S304 from step S301. When the value of the timer TE reaches the prescribed time E, the engine control unit 20 proceeds to step S308 and resets the value of the flag FLAGE to 0. As a result, thereafter, the engine control unit 20 proceeds from step S301 to step S9. From step S9, the engine control unit 20 closes off the purge line and executes the same processing as described previously. If it determines in step S302 that the purge line pressure P exceeds the set pressure Pst, the engine control unit 20 proceeds again to step S304 and repeats the process of opening the purge line to the atmosphere for a prescribed amount of time. The process is repeated each cycle until the purge line pressure P is equal to or below the set pressure Pst. Once the purge line pressure P is equal to or below the set pressure Pst, the engine control unit 20 executes the leak diagnosis.

Figure 10:
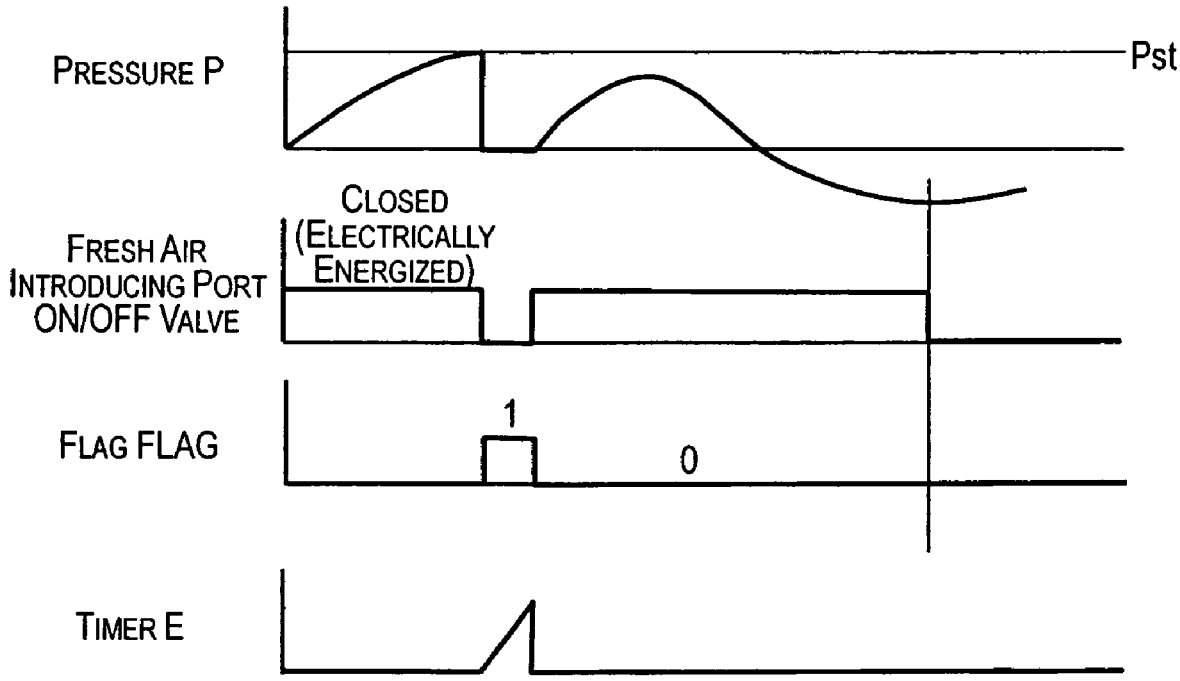
FIG. 10 is a timing chart showing a pressure behavior that occurs during a leak diagnosis in accordance with the fourth embodiment of the present invention.

FIG. 10 shows how the purge line pressure P varies over time during a diagnosis in accordance with the fourth embodiment.

With this embodiment, the purge line is only opened to the atmosphere when the amount of fuel vapor is large and the pressure rise that occurs immediately after the engine is stopped is too large. As a result, the electric power consumption can be reduced and the diagnosis can be completed quickly.

Also, since, in this embodiment, the leak determination (diagnosis result) is only executed when the difference between the fuel temperature that exists when the engine is stopped and the fuel temperature that existed when the engine was started is equal to or above a prescribe value, the temperature can be ensured to decrease by an amount that is sufficient to maintain the high accuracy of the leak diagnosis.

As used herein to describe the above embodiments, the term "detect" as used herein to describe an operation or function carried out by a component, a section, a device or the like includes a component, a section, a device or the like that does not require physical detection, but rather includes determining, measuring, modeling, predicting or computing or the like to carry out the operation or function. The term "configured" as used herein to describe a component, section or part of a device includes hardware and/or software that is constructed and/or programmed to carry out the desired function. Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A fuel vapor treatment system comprising:

a canister configured to temporarily adsorb fuel vapor from a fuel tank;

a fresh air introducing port fluidly connected to the canister to introduce fresh air into the canister with a fresh air introducing port on/off valve disposed in the fresh air introducing port to open and close the intake air introducing port of the canister;

a purge line fluidly connected to the canister to send the fuel vapor adsorbed in the canister to an air intake system of an internal combustion engine by introducing fresh air into the canister through the fresh air introducing port and allowing the fresh air and fuel vapor to be drawn into the air intake system through a purge control valve disposed in the purge line;

a pressure detecting device arranged and configured to detect a purge line pressure within the purge line; and a leak diagnosis control device configured and arranged to close the purge control valve and the fresh air introducing port on/off valve to close off the purge line after determining engine operation is stopped, and the leak diagnosis control device being further configured to conduct a leak determination to determine a leakage state of the purge line based on an amount by which the purge line pressure of the purge line decreases due to a temperature decrease occurring within a temperature region that is lower than a prior temperature that existed immediately after the engine was stopped.

2. The fuel vapor treatment system recited in claim 1, wherein the leak diagnosis control device further is configured to calculate a minimum value of the purge line pressure during a diagnostic period, and to determine that the purge line is leaking when a difference between the minimum value and atmospheric pressure is equal to or smaller than a threshold value.

3. The fuel vapor treatment system recited in claim 2, wherein the leak diagnosis control device is further configured to set the threshold value based on at least one of the atmospheric pressure, the difference between a post fuel temperature when the engine operation was started and a pre-fuel temperature when the engine operation was stopped, and a volume of empty space inside the fuel tank.

4. The fuel vapor treatment system recited in claim 2, wherein the leak diagnosis control device is further configured to close off the purge line immediately after an engine stop operation has been executed, temporarily open the purge line at a point in time when the purge line pressure is at a maximum, leave the purge line open for a prescribed amount of time, close off the purge line again after the prescribed amount of time has elapsed, calculate a minimum value reached by the purge line pressure after the purge line is closed again, and use the minimum value in the leak determination.

5. The fuel vapor treatment system recited in claim 2, wherein the leak diagnosis control device is further configured to close off the purge line after a prescribed amount of time has elapsed since an engine stop operation was executed and to start the leak determination after the purge line has been closed off.

6. The fuel vapor treatment system recited in claim 2, wherein the leak diagnosis control device is further configured to close off the purge line after an engine stop operation has been executed, temporarily open the purge line for a prescribed amount of time if the purge line pressure exceeds a prescribed value, close off the purge line again after the prescribed amount of time has elapsed, repeat opening and closing of the purge line until the purge line pressure does not exceed the prescribe value, and start the leak determination after the purge line pressure no longer exceeds the prescribed value.

7. The fuel vapor treatment system recited in claim 3, wherein the leak diagnosis control device is further configured to close off the purge line immediately after an engine stop operation has been executed, temporarily open the purge line at a point in time when the purge line pressure is at a maximum, leave the purge line open for a prescribed amount of time, close off the purge line again after the prescribed amount of time has elapsed, calculate a minimum value reached by the purge line pressure after the purge line is closed again, and use the minimum value in the leak determination.

8. The fuel vapor treatment system recited in claim 3, wherein the leak diagnosis control device is further configured to close off the purge line after a prescribed amount of time has elapsed since an engine stop operation was executed and to start the leak determination after the purge line has been closed off.

9. The fuel vapor treatment system recited in claim 3, wherein the leak diagnosis control device is further configured to close off the purge line after an engine stop operation has been executed, temporarily open the purge line for a prescribed amount of time if the purge line pressure exceeds a prescribed value, close off the purge line again after the prescribed amount of time has elapsed, repeat opening and closing of the purge line until the purge line pressure does not exceed the prescribe value, and start the leak determination after the purge line pressure no longer exceeds the prescribed value.

10. A fuel vapor treatment system comprising:

adsorbing means for temporarily adsorbing fuel vapor evaporated from a fuel tank;

fresh air introducing means for selectively introducing and stopping fresh air into the adsorbing means;

purging means for regulating fuel vapor flows from the adsorbing means to an air intake system of an internal combustion engine by introducing fresh air into the adsorbing means via the fresh air introducing means and allowing the fresh air and fuel vapor to be drawn into the air intake system through the purging means;

absolute pressure sensor means for detecting purge line pressure inside the purging means; and leak diagnosis control means for closing the purging means and the fresh air introducing means to close off a portion of the fuel vapor treatment system between the air intake system and the adsorbing means after determining engine operation is stopped, and for conducting a leak diagnosis to determine a leakage state of the purging means based on an amount by which the purge line pressure decreases due to a temperature decrease occurring within a temperature region that is lower than a prior temperature that existed immediately after the engine was stopped.

11. A method for diagnosing a fuel vapor treatment system having a canister disposed between a fuel tank and an air intake system of an internal combustion engine with a purge line that leads from the canister to the air intake system and a fresh air introducing port that allow fresh air and fuel vapor to be drawn into the air intake system, the method comprising:

detecting pressure inside a purge line pressure within the purge line of the fuel vapor treatment system having a fuel tank fluidly connected to an intake passage of an internal combustion engine with a canister that is configured to adsorb fuel vapor from the fuel tank;

closing a purge control valve and a fresh air introducing port on/off valve to close off the purge line after determining engine operation is stopped; and conducting a failure diagnosis on the fuel vapor treatment system to determine a leakage state of the purge line based on an amount by which the purge line pressure of the purge line decreases due to a temperature decrease occurring within a temperature region that is lower than a prior temperature that existed immediately after the engine was stopped.

* * * * *